US005702263A

United States Patent [19]

Baumann et al.

[11] Patent Number: 5,702,263

[45] Date of Patent: Dec. 30, 1997

[54] SELF LOCKING CONNECTOR BACKSHELL

[75] Inventors: Frederick B.B. Baumann, Claremont; Louis E. Spears, Rancho Cucamonga, both of Calif.

[73] Assignee: HiRel Connectors Inc., Claremont, Calif.

[21] Appl. No.: 614,465

[22] Filed: Mar. 12, 1996

[51] Int. Cl.[6] ..... H01R 4/38

[52] U.S. Cl. ..... 439/321

[58] Field of Search ..... 439/320, 321, 439/312, 323, 313, 314, 315, 316, 317, 318, 319

[56] References Cited

U.S. PATENT DOCUMENTS

| | | | |
|---|---|---|---|
| 5,199,894 | 4/1993 | Kalny et al. | 439/321 |
| 5,435,760 | 7/1995 | Miklos | 439/321 |

*Primary Examiner*—Khiem Nguyen
*Assistant Examiner*—Yong Ki Kim
*Attorney, Agent, or Firm*—Sheldon & Mak

[57] ABSTRACT

A system for releasably locking and unlocking a connector and backshell combination for supporting conductors that extend from the connector includes a threaded clamping ring in an assembly having facing first and second detent rings that are formed with respective multiplicities of mating detent members. The first detent ring is angularly fixed relative to the clamping ring; the second detent ring is affixed to or integral with a flange ring that is affixed to a body of the backshell. The backshell body can have an enlargement such as for a conductor clamp, in which case the detent ring is affixable subsequent to location of at least the first detent ring between the flange ring and the enlargement when the enlargement would block assembly from that direction. A nested plurality of cone-shaped spring washer axially holds the detent rings in facing engagement, whereby a total surface contacting area of engagement between the detent members is at least 0.1 times the product of an average engagement pitch diameter and the width of engagement. The first and second detent members can engage at shallow contact angles of not more than about 30 degrees for preventing jamming from toothed accessory ring camming action. The assembly preferably includes an adjustment ring threadingly engaging the clamping ring for adjustably preloading the spring washers, and a pair of resilient 0-ring members frictionally connecting the clamping ring and the backshell body for dampening vibrations therebetween, and for sealingly enclosing the detent members and the spring washers.

26 Claims, 3 Drawing Sheets

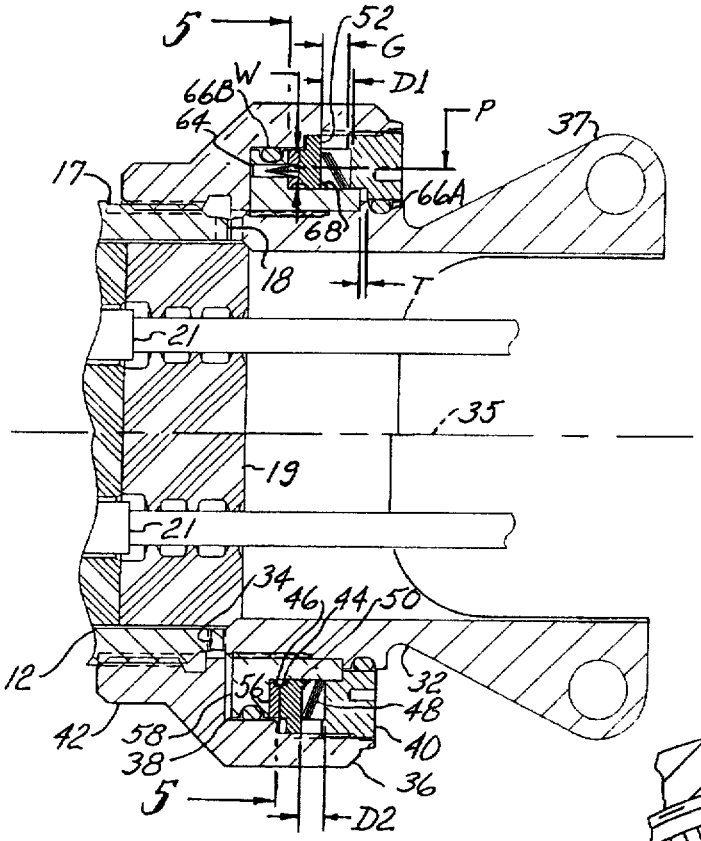
Fig. 4.
Fig. 5.
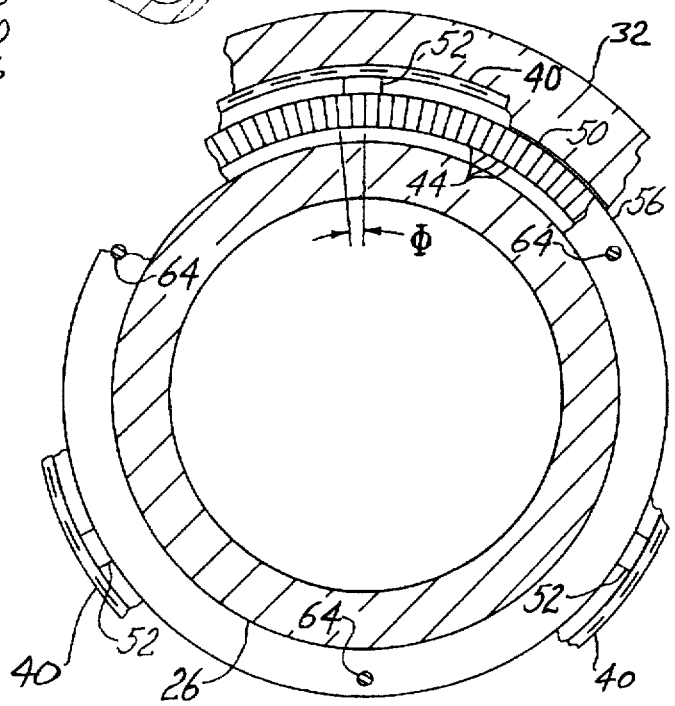

SELF LOCKING CONNECTOR BACKSHELL

BACKGROUND

The present invention relates to plugable connectors such as electrical connectors that are typically used in high-performance aircraft and other vehicles, that must withstand severe vibration and other adverse environmental conditions.

Connector assemblies for severe environments are typically held in mating engagement by a clamp ring of one connector portion threadingly engaging the mating connector portion. Traditionally, the clamp ring is held in its clamping state by having the ring configured with a single lead thread having a pitch of about 20 threads per inch, and by the use of safety wire. More recently, coarser and/or multiple-lead threads have been preferred for permitting rapid coupling and uncoupling of the assemblies. Connectors of this type include those known as "Series III" connectors that are specified in standard shell sizes 9–25 for many high-performance applications according to MIL-C-38999/26D (dated 7 May 1990), which is incorporated herein by this reference.

When Series III connectors are subjected to heavy vibration, it is required that the mating portions maintain a solid metal-to-metal face contact. It is also required that the performance under vibration be maintained even after a certain minimum number of complete engagements and disengagements of the mating portions. For this purpose, some form of locking device is provided for the clamp ring. U.S. Pat. No. 5,199,894 to Kalny et al., which is incorporated herein by this reference, discloses a self-locking connector that is particularly advantageous in meeting the above requirements. A further feature of many connectors is that optional accessories are attachable thereto. These accessories include backshell assemblies for supporting and clamping conductors that extend from the connectors.

With reference to FIGS. 1 and 2, a conventional backshell attachment 10 for a connector 12 includes a first shell body 14, a clamp ring 16 rotatably connected to the shell body 14 and threadingly engaging a second shell body 17 of the connector 12. Respective rings 18 and 20 of the shell bodies 14 and 17 are axially clamped together for maintaining a selected angular relation between the shell bodies 14 and 17, a resilient grommet 19 of the connector 12 (having electrical contacts 21 therein) being axially compressed approximately 5 percent when the accessory rings 18 and 20 are fully engaged. The first and second accessory rings 18 and 20 are notched to respective depths N1 and N2 at respective angles Q1 and Q2 for forming a mating tooth interface. The rings 18 and 20 have respective outside corner radii R1 and R3 and respective inside corner radii R2 and R4 at surface intersections thereof. In one conventional and standard interchangeable configuration, the depths N1 and N2 are 0.027±0.004 inch, the angles Q1 and Q2 are 100±2 degrees, the outside corner radii R1 and R3 are 0.012±0.005 inch, and the inside corner radii R2 and R4 are 0.009±0.005 inch. In the exemplary prior art implementation of FIGS. 1 and 2, the clamp ring 16 includes a threaded ring 22 having a pair of retainer segments 24 affixed therein by swaging or other conventional means, the segments 24 bearing against a flange portion 26 of the first shell body 14. Prior art accessory backshells may have a locking device (not shown) in which radially projecting ratchet teeth engage one or more spring-loaded detent members as described in the above-referenced '894 patent to Kalny et al.

The prior art backshell accessories of the type shown in FIGS. 1 and 2 are subject to one or more of the following disadvantages:

1. The locking device is ineffective in that it does not maintain the required solid metal-to-metal face contact in that even a slight vibration can cause the ring to back off slightly, the face-to-face contact being immediately lost as pressure is released from a compressively loaded elastomer that typically seals contact pins of the connector;
2. The locking device is ineffective in that detent members, if present, have very little contact surface area, rapidly wearing away the teeth;
3. The structural integrity of the accessory is suspect, in that weak retaining rings or unreliable swaging operations are used for coupling the clamp ring to the body;
4. The accessory is expensive to provide and difficult to service due to the presence of the weak retaining rings and/or swaged connections; and
5. The locking device is unreliable in that harmful foreign matter is not excluded, being damaged when the connector is decoupled, such as when water freezes within the device.

Thus there is a need for a connector accessory that overcomes the above disadvantages.

SUMMARY

The present invention meets this need by providing a system for locking and unlocking a connector backshell accessory having a threaded clamping ring to a toothed connector accessory ring. The connector backshell includes a backshell body for receiving conductor elements; a circular toothed backshell ring axially projecting on an accessory pitch circle from the backshell body about a backshell axis for engaging the accessory ring at respective first and second accessory ramp angles θ1 and θ2 that reflect axial movement of the backshell body within a distance ξ away from the accessory ring in response to rotation of the backshell body about the backshell axis relative to the accessory ring in opposite directions from seated engagement with the accessory ring; a threaded clamping ring rotatably coaxially supported on the backshell body and threadingly engageable with the connector assembly in respective clamping and unclamping directions of rotation therewith for holding the backshell body in axial engagement with the accessory ring, the angle θ1 corresponding to rotation of the backshell body in the clamping direction relative to the accessory ring; a multiplicity of first detent members supportively coaxially located in a fixed angular relation to the clamping ring; a multiplicity of second detent members supportively coaxially located in a fixed angular relation to the backshell body, the first and second detent members being simultaneously engagable on a detent pitch circle, wherein the first and second detent members engage at a first contact angle A between a tangent of the pitch circle and a first surface of contact between each first detent member and a contacting second detent member during rotation of the clamping ring in the clamping direction relative to the backshell body, the first and second detent members also engaging at a second contact angle B between a tangent of the pitch circle and a second surface of contact between each first detent member and a contacting second detent member during rotation of the clamping ring in the unclamping direction relative to the backshell body; and biasing means for axially holding the first and second detent members in facing engagement, the angle A being sufficiently less than the angle θ1 and the angle B being sufficiently less than the angle θ2 for permitting rotation of the clamping ring to effect seated engagement and disengagement between the backshell body and the connector assembly.

The angle A can be not greater than approximately 30°. Preferably the angle A is not greater than approximately 20° for smoothly achieving a locked condition with seated engagement of the accessory ring. The angle B is preferably not greater than approximately 30° for avoiding a jammed condition stemming from accessory ring camming. More preferably the angle B is approximately 20°.

The detent pitch circle can have an average detent pitch diameter P, the first and second detent members have a detent engagement width W, and a total surface contacting area of engagement between the detent members is at least 0.1 times the product of P and W. The first and second detent members can be engagable in a multiplicity M of equally spaced positions having an angular spacing Φ and an equivalent tangential spacing S, the total surface contact area of engagement being maintained at not less than approximately 0.05 times the product of P and W during rotational movement of the second detent members relative to the first detent members through an angle not less than half of the angular spacing Φ. The maximum displacement of the first and second detent members in a direction normal to the detent pitch circle during biased engagement between adjacent detented positions can be not greater than approximately 0.2 S. Preferably the maximum displacement of the first and second detent members is approximately 0.010.

The first detent members can be fixably connected on a first detent ring, the second detent members being fixed relative to the backshell body, the first detent ring being axially movable relative to the clamping ring, the biasing means comprising a cone-shaped spring washer coaxially supported relative to the backshell body. Preferably the spring washer contacts the first detent ring along a continuous annular contact path for uniform axial biasing of the detent members. The spring washer can in a nested plurality of spring washers, each having a thickness of approximately 0.003 inch. The first detent ring can axially slidably engage an engagement surface that is fixed relative to the clamping ring.

Preferably the connector backshell further includes an adjustment ring threadingly engaging the clamping ring for adjustably preloading the spring washer. The clamping ring can be axially movable relative to the backshell body between an open position having an associated first biasing level of the spring washer when the clamping ring is in a disengaged position and a closed position having an associated second biasing level of the spring washer when the clamping ring is in a locked position, the second level being higher than the first level. The connector backshell can further include a second detent ring, the second detent members being formed in the second detent ring.

The backshell body can be formed having an enlargement such as for a cable clamp blocking passage of the clamping ring, the backshell further including a rigid flange ring blocking passage of the first detent members, and means for fixedly connecting the flange ring to the backshell body with the first detent members located between the flange ring and the enlargement. The flange ring can threadingly engage the backshell body. The second detent members can be integrally formed with the flange ring.

The connector backshell can be in combination with the connector assembly that includes a connector body, the accessory ring rigidly extending from the connector body, the connector body being threadingly engaged by the clamping ring, wherein the biasing means provides an axial biasing force at a first force level prior to seating engagement between the backshell ring and the accessory ring, the force increasing to a second, higher force level subsequent to the seating engagement in response to continued advancement of the clamping ring in the clamping direction relative to the connector body.

Preferably the connector backshell further includes a pair of resilient ring members frictionally connecting the clamping ring and the backshell body for dampening vibrations therebetween, the ring members being axially located on opposite sides of the first and second detent members, the ring members in combination with the backshell body and the clamping ring sealingly enclosing the first and second detent members and the biasing means. The connector backshell can further include an end ring connected to the clamping ring, one of the resilient ring members sealingly contacting the end ring. The connector backshell can further include a lubricant for the detent members that is sealingly retained between the resilient ring members.

DRAWINGS

These and other features, aspects, and advantages of the present invention will become better understood with reference to the following description, appended claims, and accompanying drawings, where:

FIG. 4 is a fragmentary lateral sectional view of a connector and backshell combination incorporating an improved locking mechanism according to the present invention;

FIG. 5 is a fragmentary sectional view of the combination of FIG. 4 on line 5—5 therein;

DESCRIPTION

Figure 1:
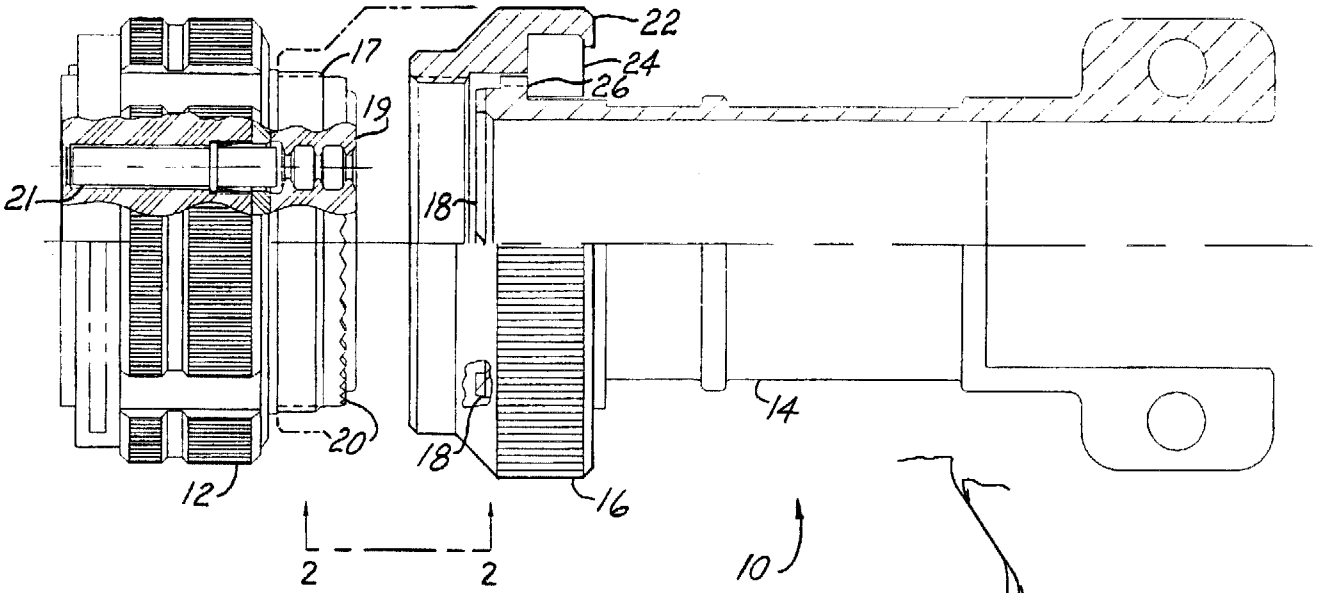
Fig. 1. (PRIOR ART)
FIG. 1 is an axial sectional diagrammatic view of a prior art connector and backshell accessory combination.

The present invention is directed to a connector backshell accessory having an improved locking mechanism. As described above with reference to FIGS. 1 and 2 of the drawings, a prior art connector assembly 12 includes a connector body 17 having an accessory ring 20, and an array of interface elements or contacts 21, the contacts 21 being supported within the connector body 17 by a resilient insert 19. With further reference to FIGS. 3–7, a connector backshell 30 according to the present invention includes a backshell body 32 having a toothed backshell ring 34 for engaging the accessory ring 20 of the connector assembly 12 in concentric relation to a backshell axis 35 of the backshell body 32, and a locking clamp ring assembly 36 for securing the backshell body onto the connector 12. As shown in FIG. 4, the backshell body 32 is formed having an integral enlargement 37 for supporting a conventional conductor clamp assembly. The clamp ring assembly 36 is rotatably mounted concentric with the backshell axis 35 for threadingly engaging the connector body 17 and rigidly clamping the backshell body 32 thereto with the backshell ring 34 seated in angularly locked metal-to-metal contact against the accessory ring 20 in a desired angular relation with the connector assembly 12.

According to the present invention, a flange ring 38 is assembled in fixed relation to the backshell body 32, the ring 38 transmitting axial clamping force between the clamp ring assembly and the backshell body 32. The clamp ring assembly 36 includes a rigid cap member 40 and a clamping ring 42 fixably connected thereto, the clamping ring 42 being formed for threaded engagement with the connector body 17. The cap member 40 is located opposite the flange ring 38 and carries the axial clamping force between the clamping ring 42 and the flange ring 38. In an exemplary configuration of the backshell 30, the flange ring 38 threadingly engages the backshell body 32, being affixed thereto by a suitable locking adhesive. Also, the threaded engagement between the flange ring 38 and the backshell body 32 is opposite-handed from the threaded engagement of the connector body 17 by the clamping ring 42 for further inhibiting movement of the flange ring 38 during tightening of the clamping ring 42 onto the connector body 17. For example, the threaded engagement with the backshell member 32 is preferably left-handed when the engagement by the clamping ring 42 is right-handed according to conventional practice. Assembly of the backshell body 32, the flange ring 38, the retainer ring 40, and the clamping ring 42, includes locating the retainer ring 40 on the backshell body 32 between the enlargement 37 and the eventual location of the clamping ring 42 before attaching the flange ring 38 to the backshell body 32. Then, with the clamping ring 42 in position on the flange ring 38, the retainer ring 40 is assembled to the clamping ring 42. This combination advantageously allows the clamping ring 42 to be properly small in size, not having to be passed over the enlargement 37, but without having to compromise the structural integrity of the clamp ring assembly 36 by the use of split and/or flexible retaining rings.

In further accordance with the present invention, a set of first detent teeth 44 axially project within the clamping ring 42 in fixed angular relation thereto, for engagement with a corresponding number of second detent teeth 46 that are fixably located relative to the backshell body 32 on the flange ring 38. At least one but preferably a plurality of cone-shaped spring washers 48 are interposed between the cap member 40 and the first detent teeth 44 for biasing the first and second detent teeth 44 and 46 into simultaneous engagement. In an exemplary configuration of the backshell 30 shown in FIGS. 4–6, the first detent teeth 44 are formed in one face of a first clutch plate 50, the plate 50 having three outwardly projecting lugs 52 that axially slidably engage the cap member 40. The cap member 40 is threadingly connected to the clamping ring 42, being locked in a rigidly fixed position relative to the ring 42 subsequent to adjustment therewith as described below. The second detent teeth 46 are formed in one face of a second clutch plate 56 that is fixably connected to the flange ring 38, thereby being fixed relative to the backshell body 32. The teeth 44 and 46 are located on an average pitch diameter P, having a width of engagement W in a radial direction normal to a tangent of the pitch diameter P. Thus the teeth 44 and 46 are spaced along a circumference $C = \pi P$, within a gross area CW.

The clamping ring 42 is axially movable on the backshell body 32 by a distance T, the ring 42 being shown in a rearward, unclamped position in the top half of FIG. 4 wherein the ring 42 engages a front face surface 58 of the flange ring 38. The distance T corresponds to an axial clearance between a rear extremity of the flange ring 38 and the cap member 40, depending on the adjustment of the cap member 40. Similarly, an axial clearance G is provided between the lugs 52 and the cap member 40, and the spring washers 48 are confined within an axial spacing D1 when the clamping ring 42 is in its rearward position, the detent teeth 44 and 46 being fully engaged. In the bottom half of FIG. 4, the clamping ring 42 is shown in its forward position wherein the cap member 40 bears against the flange ring 38, the distance T representing an axial clearance between the clamping ring 42 and the face surface 58 of the flange ring 38, the spring washers 48 being confined within a spacing D2, D2 being smaller than D1. The axial clearance G is preferably greater than the distance T, for permitting continued axial compression of the spring washers 48 after the cap member 40 makes abutting contact with the rear extremity of the flange ring 38.

Figure 6:
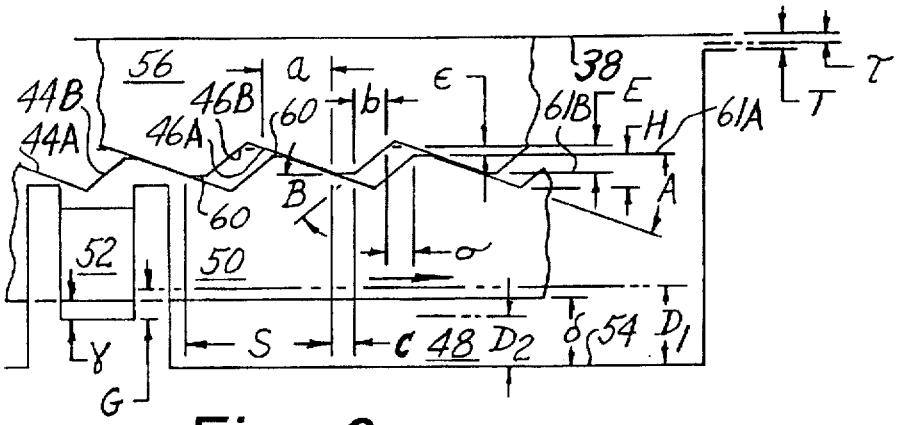
FIG. 6 is a lateral detail diagrammatic view of a portion of the combination of FIG. 4.
Figure 7:
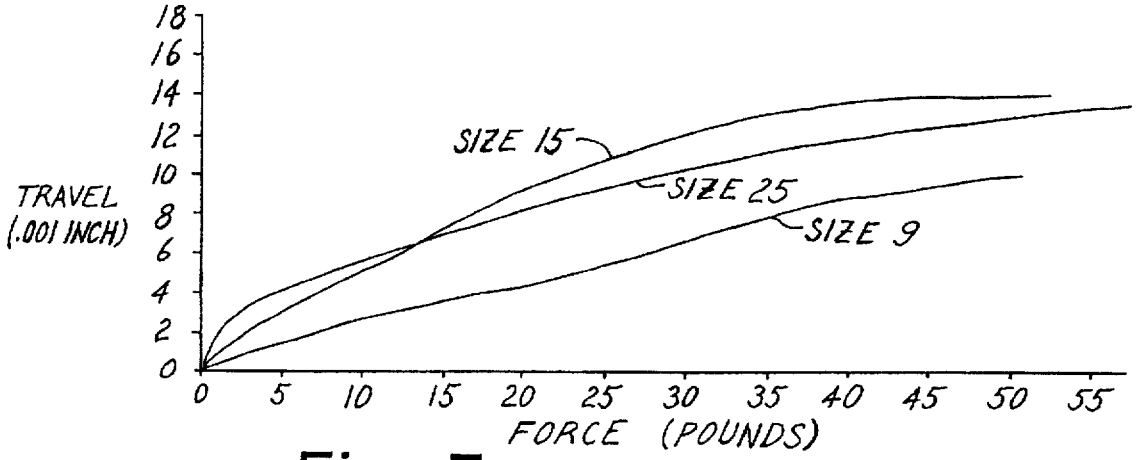
FIG. 7 is a graph of spring force test results of experimental prototypes of the combination of FIG. 4.

As best shown in FIG. 6, the detent teeth 44 and 46 are each formed with a trapezoidal profile, being joined end-to-end at a circular pitch or spacing S and having a flattened crown portion 60 of width c, the crown portions 60 defining respective crown surfaces 61A and 61B of the respective clutch plates 50 and 56 in planes perpendicular to the backshell axis 35 in the exemplary configuration of the backshell 30 of FIGS. 4 and 5.

As also shown in FIG. 4, the second clutch plate 56 is connected to the flange ring 38 of the backshell body 32 by at least one (preferably three) dowel pins 64, the pins 64 preferably having a solid configuration incorporating a conventional tapered groove for locking engagement with the flange ring 38. The configuration of FIG. 4 also preferably includes at least one resilient member connecting the clamping ring 42 and the backshell body 32 for attenuating or dampening vibrations therebetween under severe environmental conditions. For this purpose, a pair of resilient rings 66, designated 66A and 66B in FIG. 4, are frictionally connected between the clamping ring 42 and the backshell body 32, the rings 66 being located axially for sealingly enclosing the spring washer 48 and the clutch plates 50 and 56. As further pointed out below, the rings 66 materially improve the integrity of the connector backshell 30 under severe vibration, both in the fully locked condition and in a partially locked condition. Also, the rings 66 advantageously provide for the retention of a suitable lubricant in the space containing the clutch plates 50 and 56, and the spring washer 48.

A first ramp surface 44A and a corresponding first ramp surface 46A of each of the teeth 44 and 46 have a flat profile, sloping at a first ramp angle A from the crown surfaces 61 in a direction compressing the spring washer 48 when the first clutch plate 50 is rotated with the clamping ring 42 in a first direction for clamping the second shell member 30 as indicated by the arrow in FIG. 6. Similarly, a second ramp surface 44B and a corresponding second ramp surface 46B of each of the teeth 44 and 46 have a flat profile, sloping at a second ramp angle B from the crown surfaces 61 in a direction compressing the spring washer 48 when the first clutch plate 50 is rotated with the clamping ring 42 in an opposite second direction for releasing the second shell member 30.

As further shown in FIG. 6, when the teeth 44 and 46 are fully engaged, the first ramp surfaces 44A and 46A have a length of engagement a in the direction of the spacing S, and the second ramp surfaces 44B and 46B have a corresponding length of engagement b, wherein $a+b=S-2c$. Accordingly, a maximum area of engagement between the clutch plates 50 and 56 can be expressed as $A_M=CW(a+b)/S$. When the clamping ring 42 is rotated in the clamping first direction, the rotation is resisted by an axial spring force F from the spring washer 48 that produces compressive loading between the first ramp surfaces 44A and 46A of the clutch plates 50 and 56, the force F being distributed over a forward area of engagement $A_R$=CW(a−σ)/S, where σ is a circular distance of movement between the teeth 44 and 46 in the first direction relative to the fully engaged position, σ being less than a. Conversely, when the clamping ring 42 is rotated in the second direction for releasing the clamping, the force F is distributed over a reverse area of engagement $A_R$=CW (b−σ)/S, σ being less than b, taken in the second direction relative to the fully engaged position.

In a preferred configuration of the connector backshell 30 for standard shell sizes 9 through 25, there are a large multiplicity M of the detent teeth 44 and 46, the number M ranging from approximately 80 in size 9 to in excess of 200 in size 25. Thus an angle Φ between adjacent fully engaged positions of the clutch plates 50 and 56 ranges from approximately 5° in shell size 9 to approximately 2° in shell size 25. When the connector backshell 30 is configured generally as shown in FIG. 4, the average pitch diameter P ranges from approximately 0.6 inch in shell size 9 to approximately 1.6 inch in shell size 25. The teeth 44 and 46 are preferably formed with a tooth height H of not more than approximately 0.005 inch, the angle B being not less than approximately equal to the angle A. Further, the spacing S is preferably between approximately 0.02 inch and approximately 0.04 inch, the crown width c of the teeth 44 and 46 being preferably between approximately 0.001 inch and approximately 0.005 inch for providing a significant contact area between the crown portions 60 of teeth 44 and 46 when the clutch plates 50 and 56 are moved between adjacent engagement positions, while preserving an even larger area of engagement between the first ramp surfaces 44A and 46A, and between the second ramp surfaces 44B and 46B through a large portion of the rotation of the clutch plates 50 and 56 between the adjacent fully engaged positions. Correspondingly, a full engagement depth E between the first and second detent teeth 44 and 46 is preferably between about 0.003 inch and about 0.005 inch. Dynamically, the depth E is reduced by a distance ε during rotation of the clamping ring, where ε=σ tan A in the first direction of rotation and ε=σ tan B in the second direction of rotation. Similarly, a distance δ between opposite sides of the spring washer 48 decreases from D1 and D2, also according to the distance ε. Moreover, a distance γ between the lugs 52 of the first clutch plate 50 and the cap member 40 also decreases from the initial axial clearance G according to the distance ε.

For example, when the spacing S is 0.03 inch and the crown width c is 0.003 inch, the maximum area of engagement $A_M$ is approximately 80 percent of the product of the average pitch circumference C and the width of engagement W. Even when the spacing S is reduced to 0.02 inch and the crown width c is increased to 0.005 inch, $A_M$ is generously greater than 50 percent of the product of C and W. More importantly, as the clamping ring 42 is rotated between adjacent fully engaged positions of the clutch plates 50 and 56 in the case of the spacing S being 0.03 inch and the crown width c being 0.003 inch, a dynamic area of engagement $A_o$between the detent teeth 44 and 46 is equal to or greater than approximately 0.1 times the product of C and W through approximately 60 percent of a detent engagement angle Φ between the adjacent positions. Even in the case where the spacing S is 0.02 and the crown width c is increased to 0.005 inch, the contact area remains at or above 0.05 times the product of C and W through 70 percent of that portion of the angle Φ wherein the first ramp surfaces 44A and 46A, or the second ramp surfaces 44B and 46B are in mating contact.

As disclosed in the above-referenced U.S. Pat. No. 5,199,894, it would be desirable in a self-locking connector to have the second ramp angle B relatively great for positive locking against rotation of the clamp ring assembly 36 under severe vibration, and it would be further desired to have the first and second ramp angles A and B relatively great to, obtain a desired high density of the detent teeth 44 and 46 while providing a desired detenting effectiveness.

In developing the connector backshell 30 of the present invention, an unexpectedly encountered problem was jamming of the clamp ring assembly 30 against rotation in the unclamping direction when it was desired to unclamp the backshell 30 from the connector 10. This discovery was made during experiments conducted using connector backshells having self-locking clamping rings as disclosed in the '894 patent and incorporating detent rings having the angle A being 20° and the angle B being 40° according to a most preferred commercial self-locking connector embodiment of the '894 patent. It was further discovered that the jamming resulted from a tendency of the backshell body 32 to move axially away from the connector body 17 as unclamping torque was applied, due to a combination of compressive loading of the resilient grommet 19 and camming engagement between contacting portions of the backshell ring 34 and the accessory ring 20. More particularly, in the locked condition of the backshell assembly 30, the resilient grommet is displaced approximately 5 percent. As the clamping ring 42 is turned in the unclamping direction the axial force holding the rings 20 and 34 in seated engagement is gradually released, allowing teeth of the backshell ring 34 to "climb up" on the previously interlocking teeth of the accessory ring 20 as the backshell body 32 rotates with the clamping ring 42 in the unclamping direction. When the backshell body 32 and the connector body 17 are driven apart in this manner the spring washers 48 remain substantially fully compressed, with consequent nearly maximum anti-rotation forces, leading to difficulty in unmating the backshell assembly 30 from the connector 10.

In overcoming this problem, it has been discovered that the second ramp angle B should be made sufficiently small that significant relaxation of the spring washers 48 occurs before the seated engagement between the backshell ring 34 and the accessory ring 20 is disturbed during unclamping rotation of the clamp ring assembly 36.

Figure 2:
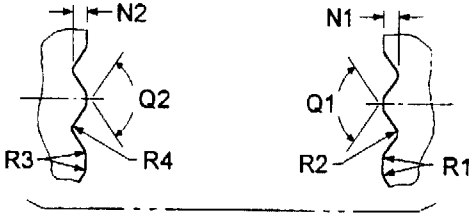
Fig. 2. (PRIOR ART)
FIG. 2 is a detail view of accessory ring portions of the combination of FIG. 1 on line 2—2 thereof.

Further, it is preferred that an effective contact angle between the backshell ring 34 and the accessory ring 20 be large for resisting the above-described camming tendancy that leads to jamming of the clamp ring assembly 36. However, the form of the rings 20 and 34 in many applications is dictated by industrial and/or government standards of interchangeability. For example, the notch depths N1 and N2 in FIG. 2 are restricted to 0.027±0.004 inch under MIL-C-38999 and conventional practice in these applications. Similarly, the notch angles Q1 and Q2 are restricted to 100±2 deg., the radii R1 and R3 are restricted to 0.012±0.005 inch, and the radii R2 and R4 are restricted to 0.009±0.005 inch.

Figure 3:
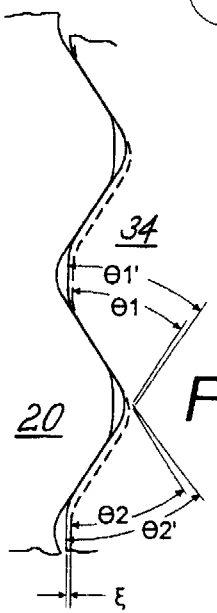
FIG. 3 is a detail view showing accessory ring portions corresponding to the portions of FIG. 2, in mating engagement.

FIG. 3 shows seated engagement and partially seated engagement between the backshell ring 34 and the accessory ring 20 of the connector 12. Respective angles θ1 and θ2 designate opposite contact angles, from a pitch circle tangent normal to the backshell axis 35, when the rings 20 and 34 are axially spaced by a distance ξ from a fully seated condition, θ1 representing contact resisting rotation of the backshell ring 34 in a clockwise direction relative to the accessory ring 20. Similarly, θ1' and θ2' are corresponding contact angles in fully seated engagement between the backshell ring 34 and the accessory ring 20. Accordingly, the seated contact angles θ1' and θ2' are nominally 40 deg. and can be only 39 deg. within the above restrictions (or less if the angles Q1 and Q2 are not exactly bisected by lines parallel to the backshell axis 35). Further, the effective contact angles θ1 and θ2 can become even less when the axial separation ξ is quite small, on the order of 0.002 inch. For example, the effective contact angle θ1 or θ2 becomes only approximately 35° at an axial separation ξ of 0.002 inch in a "worst-case" combination of N1, N2, Q1, Q2, R1, and R2. At this separation, the resilient insert 19 still exerts approximately 8 lb force, and the springs 48 still provide approximately 20 lb force in a shell size 15 configuration. Thus it is preferred that the ramp angles A and B be substantially less than the respective contact angles θ1 and θ2 for preventing the above-described jamming that would otherwise result from climbing between the backshell ring 34 and the accessory ring 20. In testing of the present invention it has been determined that one preferred configuration has the ramp angle A being 20° and the ramp angle B being 30°. In another preferred configuration, the angles A and B are both approximately 20°. In another aspect, the effective contact angles θ1 and θ2 can be increased within the previously defined parameters by forming the backshell ring 34 with the notch depth N1 at or near the maximum of 0.031 inch, the angle Q1 at or near the minimum of 98°, the radius R1 at or near the minimum of 0.007 inch, and the radius R2 at or near the maximum of 0.014 inch.

With these relationships in view, it will be apparent that the connector backshell 30 of the present invention provides greatly improved locking and unlocking action over the prior art discussed above in connection with FIGS. 1 and 2, for a number of reasons. In a first respect, the spring force F is relatively large, being provided by the cone-shaped spring washers 48, such that the ramp angles A and B can be made relatively small. The small ramp angles, and especially the second ramp angle B being not less than the ramp angle A while being substantially less than the second contact angle θ, in combination with the flattened crown portions 60 of the detent teeth 44 and 46, promote reliable locking and unlocking of the backshell 30 while greatly limiting wear of the teeth 44 and 46.

In a second respect, the spring washers 48 provide at least some clamping force for avoiding rotational movement of the clamping ring 42 when the connector backshell 30 of the present invention is subjected to vibration, even when the clamping ring 42 is not in its fully locked position.

In a third and very important respect, the present invention provides the required metal-to-metal seated contact between the backshell ring 34 and the accessory ring 20 of the connector. body 17, while permitting further rotation of the clamping ring 42 in the clamping direction, the further rotation being at least one multiple of the detent engagement angle Φ for insuring that the metal-to-metal contact is maintained even following a slight reverse rotation of the clamping ring 42 to a previously passed detent position.

Experimental prototypes of the connector backshell 30 have been fabricated and tested, with the testing continuing at present, the experimental prototypes generally conforming to the configuration of FIGS. 3–6. The clutch plates 50 and 56 were machined from 300-series corrosion resistant steel and dry film lubricated for minimizing wear and for reducing the coefficient of friction between the mating parts.

The clutch plates 50 and 56 are held under constant preload by. the spring washer 48, the force F being uniformly distributed about the circumference of the first clutch plate 50. The torque required for rotation of the clamping is dictated by spring preload which is adjusted as described above by means of the threaded cap member 40. The spring washer 48 provides a consistent 360° axial preload on the clutch plates 50 and 56 which, when adjusted during assembly by means of the rear retaining plate/end cap, equates to the desired coupling and uncoupling torque. As the spring washer 48 exerts an equal load on the first and second detent teeth 44 and 46, the surface area contact, when engaged, is unparalleled when compared to the prior art configurations of FIGS. 1–3. The interlocking clutch plates 50 and 56 provide zero backlash even in an uncoupled state of the backshell assembly 22. When metal-to-metal contact occurs between the backshell body 32 and the second shell member 30, an internal preload override feature comes into play. This feature provides for additional axial spring load to be applied to the engaged clutch plates 50 and 56, after axial movement of the clamping 24 by the distance T, which is limited by a shoulder 70 on the backshell body 32 and a corresponding surface on the cap member 40. This internal stop prevents over-stressing the spring washer 48. In this fully coupled mode, there is no rotational movement of the coupling nut. Moreover, it has been discovered that after the metal-to-metal contact is achieved, the clamping ring 42 can be advanced typically two or three multiples of the detent engagement angle Φ for further assuring continued maintenance of the metal-to-metal contact under severe vibration conditions. Even in a partially-mated condition, when there is no metal-to-metal plug/receptacle contact, the spring washer preload prevents clutch plates 50 and 56 from disengaging and allowing the shell assemblies 22 and 28 to uncouple during high vibration conditions. The spring washer 48 minimizes rocking or skewing of the clamping ring 42 in a mated or free unmated state. This cannot be said of designs employing three-point contact wave springs or products utilizing peripheral ratchets.

The entire clutch mechanism is advantageously sealed by the dual rings 66. These rings, in addition to excluding foreign matter from the lock mechanism and permitting the clutch plates 50 and 56 to be coated with a retained lubricant as described above, substantially enhance the structural integrity of the connector backshell 30 by damping vibrations of the clamping ring 42 relative to the backshell body 32 and the connector body 12, as well as by augmenting its torque of rotation, especially in the partially locked condition of the backshell 30. The connector backshell 30 of the present invention does not rely on clip-type or spiral retaining rings to captivate the clamping ring 42 or to provide a load-bearing surface during clamping or unclamping.

Although the present invention has been described in considerable detail with reference to certain preferred versions thereof, other versions are possible. For example, the second clutch ring 56 can be formed integrally with the flange ring 38, the second detent teeth 46 being preferably formed simultaneously by coining. Also the detent teeth—at least the second detent teeth 46 when formed integrally with the flange ring 38—can be formed of a high strength aluminum alloy which is preferably processed using known methods for producing a hard, wear resistant anodic coating. Further, a locking device can be used for fixedly securing the flange ring 38 on the backshell body 32. Therefore, the spirit and scope of the appended claims should not necessarily be limited to the description of the preferred versions contained herein.

What is claimed is:

1. A self-locking connector backshell for a connector assembly, a circular toothed accessory ring axially projecting from the connector assembly, the connector backshell comprising:

(a) a backshell body for receiving conductor elements;

(b) a circular toothed backshell ring axially projecting on an accessory pitch circle from the backshell body about a backshell axis for engaging the accessory ring at respective first and second accessory ramp angles θ1 and θ2, the ramp angles θ1 and θ2 reflecting axial movement of the backshell body within a distance ξ away from the accessory ring in response to rotation of the backshell body about the backshell axis relative to the accessory ring in opposite directions from seated engagement with the accessory ring;

(c) a threaded clamping ring rotatably coaxially supported on the backshell body, the clamping ring being threadingly engageable with the connector assembly in respective clamping and unclamping directions of rotation therewith for holding the backshell body in axial engagement with the accessory ring, the angle θ1 corresponding to rotation of the backshell body in the clamping direction relative to the accessory ring;

(d) a multiplicity of first detent members supportively coaxially located in a fixed angular relation to the clamping ring;

(e) a multiplicity of second detent members supportively coaxially located in a fixed angular relation to the backshell body, the first and second detent members being simultaneously engagable on a detent pitch circle, wherein the first and second detent members engage at a first contact angle A between a tangent of the pitch circle and a first surface of contact between each first detent member and a contacting second detent member during rotation of the clamping ring in the clamping direction relative to the backshell body, the first and second detent members also engaging at a second contact angle B between a tangent of the pitch circle and a second surface of contact between each first detent member and a contacting second detent member during rotation of the clamping ring in the unclamping direction relative to the backshell body; and (f) biasing means for axially holding the first and second detent members in facing engagement, the angle A being sufficiently less than the angle θ1 and the angle B being sufficiently less than the angle θ2 for permitting rotation of the clamping ring to effect seated engagement and disengagement between the backshell body and the connector assembly without producing jamming from the backshell body being driven axially away from the accessory ring by sliding engagement between the backshell ring and the accessory ring when the clamping ring is rotated.

2. The connector backshell of claim 1, wherein the angle A is not greater than approximately 30°.

3. The connector backshell of claim 2, wherein the angle A is not greater than approximately 20°.

4. The connector backshell of claim 2, wherein the angle B is not greater than approximately 30°.

5. The connector backshell of claim 4, the angle B is approximately 20°.

6. The connector backshell of claim 1, wherein the detent pitch circle has an average detent pitch diameter P, the first and second detent members have a detent engagement width W, and a total surface contacting area of engagement between the detent members is at least 0.1 times the product of P and W.

7. A self-locking connector backshell for a connector assembly a circular toothed accessory ring axially projecting from the connector assembly, the connector backshell comprising:

(a) a backshell body for receiving conductor elements;:

(b) a circular toothed backshell ring axially projecting on an accessory pitch circle from the backshell body about a backshell axis for engaging the accessory ring at respective first and second accessory ramp angles θ1 and θ2, the ramp angles θ1 and θ2 reflecting axial movement of the backshell body within a distance ξ away from the accessory ring in response to rotation of the backshell body about the backshell axis relative to the accessory ring in opposite directions from seated engagement with the accessory ring:

(c) a threaded clamping ring rotatably coaxially supported on the backshell body the clamping ring being threadingly engageable with the connector assembly in respective clamping and unclamping directions of rotation therewith for holding the backshell body in axial engagement with the accessory ring, the angle θ1 corresponding to rotation of the backshell body in the clamping direction relative to the accessory ring;

(d) a multiplicity of first detent members supportively coaxially located in a fixed angular relation to the clamping ring;

(e) a multiplicity of second detent members supportively coaxially located in a fixed angular relation to the backshell body, the first and second detent members being simultaneously engagable on a detent pitch circle, the detent pitch circle having an average detent pitch diameter P, the first and second detent members have a detent engagement width W, and a total surface contacting area of engagement between the detent members is at least 0.1 times the product of P and W, wherein the first and second detent members engage at a first contact angle A between a tangent of the pitch circle and a first surface of contact between each first detent member and a contacting second detent member during rotation of the clamping ring in the clamping direction relative to the backshell body, the first and second detent members also engaging at a second contact angle B between a tangent of the pitch circle and a second surface of contact between each first detent member and a contacting second detent member during rotation of the clamping ring in the unclamping direction relative to the backshell body, the first and second detent members being engagable in a multiplicity M of equally spaced positions having an angular spacing Φ and an equivalent tangential spacing S, and wherein the total surface contact area of engagement is maintained at not less than approximately 0.05 times the product of P and W during rotational movement of the second detent members relative to the first detent members through an angle not less than half of the angular spacing Φ; and (f) biasing means for axially holding the first and second detent members in facing engagement.

8. The connector backshell of claim 7, wherein the maximum displacement of the first and second detent members in a direction normal to the detent pitch circle during biased engagement between adjacent detented positions is not greater than approximately 0.2 S.

9. The connector backshell of claim 8, wherein the maximum displacement of the first and second detent members is approximately 0.010.

10. The connector backshell of claim 1, wherein the first detent members are fixably connected on a first detent ring, the second detent members being fixed relative to the backshell body, the first detent ring being axially movable relative to the clamping ring, the biasing means comprising a cone-shaped spring washer coaxially supported relative to the backshell body.

11. The connector backshell of claim 10, wherein the spring washer contacts the first detent ring along a continuous annular contact path for uniform axial biasing of the detent members.

12. A self-locking connector backshell for a connector assembly, a circular toothed accessory ring axially projecting from the connector assembly; the connector backshell comprising:

(a) a backshell body for receiving conductor elements;

(b) a circular toothed backshell ring axially projecting on an accessory pitch circle from the backshell body about a backshell axis for engaging the accessory ring at respective first and second accessory ramp angles θ1 and θ2, the ramp angles θ1 and θ2 reflecting axial movement of the backshell body within a distance ξ away from the accessory ring in response to rotation of the backshell body about the backshell axis relative to the accessory ring in opposite directions from seated engagement with the accessory ring;

(c) a threaded clamping ring rotatably coaxially supported on the backshell body, the clamping ring being threadingly engageable with the connector assembly in respective clamping and unclamping directions of rotation therewith for holding the backshell body in axial engagement with the accessory ring, the angle θ1 corresponding to rotation of the backshell body in the clamping direction relative to the accessory ring;

(d) a multiplicity of first detent members fixably connected on a first detent ring, the first detent ring being axially movable relative to the clamping ring;

(e) a multiplicity of second detent members fixed relative to the backshell body in a fixed angular relation to the backshell body: the first and second detent members being simultaneously engagable on a detent pitch circle wherein the first and second detent members engage at a first contact angle A between a tangent of the pitch circle and a first surface of contact between each first detent member and a contacting second detent member during rotation of the clamping ring in the clamping direction relative to the backshell body, the first and second detent members also engaging at a second contact angle B between a tangent of the pitch circle and a second surface of contact between each first detent member and a contacting second detent member during rotation of the clamping ring in the unclamping direction relative to the backshell body; and (f) a nested plurality of cone-shaped spring washers coaxially supported relative to the backshell body and contacting the first detent ring in a continuous annular contact path for uniformly axially biasingly holding the first and second detent members in facing engagement, each of the spring washers having a thickness of approximately 0.003 inch.

13. The connector backshell of claim 10, wherein the first detent ring axially slidably engages an engagement surface, the engagement surface being fixed relative to the clamping ring.

14. The connector backshell of claim 10, further comprising an adjustment ring threadingly engaging the clamping ring for adjustably preloading the spring washer.

15. The connector backshell of claim 10, wherein the clamping ring is axially movable relative to the backshell body between an open position having an associated first biasing level of the spring washer when the clamping ring is in a disengaged position and a closed position having an associated second biasing level of the spring washer when the clamping ring is in a locked position, the second level being higher than the first level.

16. The connector backshell of claim 10, further comprising a second,detent ring, the second detent members being formed in the second detent ring.

17. A self-locking connector backshell for a connector assembly, a circular toothed accessory ring axially projecting from the connector assembly, the connector backshell comprising:

(a) a backshell body for receiving conductor elements;

(b) a circular toothed backshell ring axially projecting on an accessory pitch circle from the backshell body about a backshell axis for engaging the accessory ring at respective first and second accessory ramp angles θ1 and θ2, the ramp angles θ1 and θ2 reflecting axial movement of the backshell body within a distance ξ away from the accessory ring in response to rotation of the backshell body about the backshell axis relative to the accessory ring in opposite directions from seated engagement with the accessory ring;

(c) a threaded clamping ring rotatably coaxially supported on the backshell body, the backshell body being formed having an enlargement blocking passage of the clamping ring, the clamping ring being threadingly engageable with the connector assembly in respective clamping and unclamping directions of rotation therewith for holding the backshell body in axial engagement with the accessory ring, the angle θ1 corresponding to rotation of the backshell body in the clamping direction relative to the accessory ring;

(d) a multiplicity of first detent members supportively coaxially located in a fixed angular relation to the clamping ring, the backshell further comprising a rigid flange ring blocking passage of the first detent members, and means for fixedly connecting the flange ring to the backshell body with the first detent members located between the flange ring and the enlargement;

(e) a multiplicity of second detent members supportively coaxially located in a fixed angular relation to the backshell body, the first and second detent members being simultaneously engagable on a detent pitch circle, wherein the first and second detent members engage at a first contact angle A between a tangent of the pitch circle and a first surface of contact between each first detent member and a contacting second detent member during rotation of the clamping ring in the clamping direction relative to the backshell body, the first and second detent members also engaging at a second contact angle B between a tangent of the pitch circle and a second surface of contact between each first detent member and a contacting second detent member during rotation of the clamping ring in the unclamping direction relative to the backshell body; and (f) biasing means for axially holding the first and second detent members in facing engagement.

18. The connector backshell of claim 17, wherein the flange ring threadingly engages the backshell body.

19. The connector backshell of claim 17, wherein the second detent members are integrally formed with the flange ring.

20. The connector backshell of claim 1 in combination with the connector assembly, the connector assembly including a connector body, the accessory ring rigidly extending from the connector body, the connector body threadingly engaging the clamping ring, wherein the biasing means provides an axial biasing force at a first force level prior to seating engagement between the backshell ring and the accessory ring, the force increasing to a second, higher force level subsequent to the seating engagement in response to continued advancement of the clamping ring in the clamping direction relative to the connector body.

21. The connector backshell of claim 1, further comprising a pair of resilient ring members frictionally connecting the clamping ring and the backshell body for dampening vibrations therebetween, the ring members being axially located on opposite sides of the first and second detent members, the ring members in combination with the backshell body and the clamping ring sealingly enclosing the first and second detent members and the biasing means.

22. The connector backshell of claim 21, further comprising an end ring connected to the clamping ring, one of the resilient ring members sealingly contacting the end ring.

23. The connector backshell of claim 21, further comprising a lubricant for the detent members, the lubricant being sealingly retained between the resilient ring members.

24. The connector backshell of claim 1, wherein the backshell body is formed having an enlargement blocking passage of the clamping ring, the backshell further comprising a rigid flange ring blocking passage of the first detent members, and means for fixedly connecting the flange ring to the backshell body with the first detent members located between the flange ring and the enlargement.

25. The connector backshell of claim 6, wherein the first and second detent members are engagable in a multiplicity M of equally spaced positions having an angular spacing $\Phi$ and an equivalent tangential spacing S, and wherein the total surface contact area of engagement is maintained at not less than approximately 0.05 times the product of P and W during rotational movement of the second detent members relative to the first detent members through an angle not less than half of the angular spacing $\Phi$.

26. The connector backshell of claim 11, wherein the spring washer is one of a nested plurality of spring washers, each of the spring washers having a thickness of approximately 0.003 inch.

* * * * *